United States Patent [19]

Butka

[11] Patent Number: 4,638,755

[45] Date of Patent: Jan. 27, 1987

[54] BOAT WITH A SWINGING MAST

[76] Inventor: Kemal Butka, 372 Central Park West, New York, N.Y. 10023

[21] Appl. No.: 748,152

[22] Filed: Jun. 24, 1985

[51] Int. Cl.[4] ..... B63B 15/00

[52] U.S. Cl. ..... 114/91

[58] Field of Search ..... 114/39, 89, 90–94, 114/140, 143

[56] References Cited

U.S. PATENT DOCUMENTS

| | | | |
|---|---|---|---|
| 3,903,827 | 9/1975 | Marcil | 114/91 |
| 3,985,106 | 10/1976 | Ross | 114/91 |
| 4,005,669 | 2/1977 | Klemm | 114/91 |
| 4,117,797 | 10/1978 | Kelly et al. | 114/91 |
| 4,345,535 | 8/1982 | Ross | 114/91 |
| 4,501,215 | 2/1985 | Hart et al. | 114/91 |

*Primary Examiner*—Trygve M. Blix
*Assistant Examiner*—Stephen P. Avila
*Attorney, Agent, or Firm*—Michael J. Striker

[57] ABSTRACT

A boat has a body, a mast arranged on the body so that under the action of a wind force component acting in a first lateral direction transverse to a longitudinal axis the mast turns relative to at least a portion of the body in a first lateral direction, and an element which resists the turning of the mast in the first lateral direction and urges the mast to turn in a second lateral direction which is opposite to the first lateral direction.

4 Claims, 11 Drawing Figures

BOAT WITH A SWINGING MAST

BACKGROUND OF THE INVENTION

The present invention relates to boats. More particularly it relates to boats which ahve a body and a mast arragned on the boat body.

Boats of the above mentioned genral type are known and widely used. One of the dangers which such boats face is that under the action of wind there is a high risk of lateral capsizing. During sailing the wind force is divided into two components, namely one component acting in a longitudinal direction of the boat and providing a forward propelling force, and the other compnoent which acts laterally in a direction transverse to the longitudinal axis of the boat this lateral wind force component is responsible for lateral capsizing of boats. For reducing the risks of lateral capsizing, lead ballasts are fixed to boat keels. For smaller boats because of versatile performance drop keeps are used. These traditional balancing systems are designed to counteract the force of wind by putting substantial weight to the keels. However, when the wind force exceeds the counteraction of the additional weight, capsizing can occur.

SUMMARY OF THE INVENTION

Accordingly, it is an object of the present invention to provide a boat which avoids the disadvantages of the prior art.

More particularly, it is an object of the present invention to provide a boat in which the danger of lateral capsizing is eliminated or at least considerably reduced.

In keeping with these objects and with otehrs which will become apparent herein after, one feature of the present invention resides, briefly stated, ina boat which has a body with a longitudinal axis, a mast arranged on the body so that under the action of a lateral wind force component acting in a lateral direction transverse to the longitudinal axis the mast turns relative to at least a portion of the body in a first lateral direction, and means for resisting the lateral wind force component and urging the mast to move in a second lateral direction which is opposite to the first lateral direction.

The novel features which are considered as characteristic for the invention are set forth in particular in the appended claims. The invention itself, however, both as to its 20 construction and it method of operation, together with additional objects and advantages thereof, will be best understood from the following description of specific embodiments when read in connection with the accompanying drawing.

DESCRIPTION OF PREFERRED EMBODIMENTS

Figure 1:
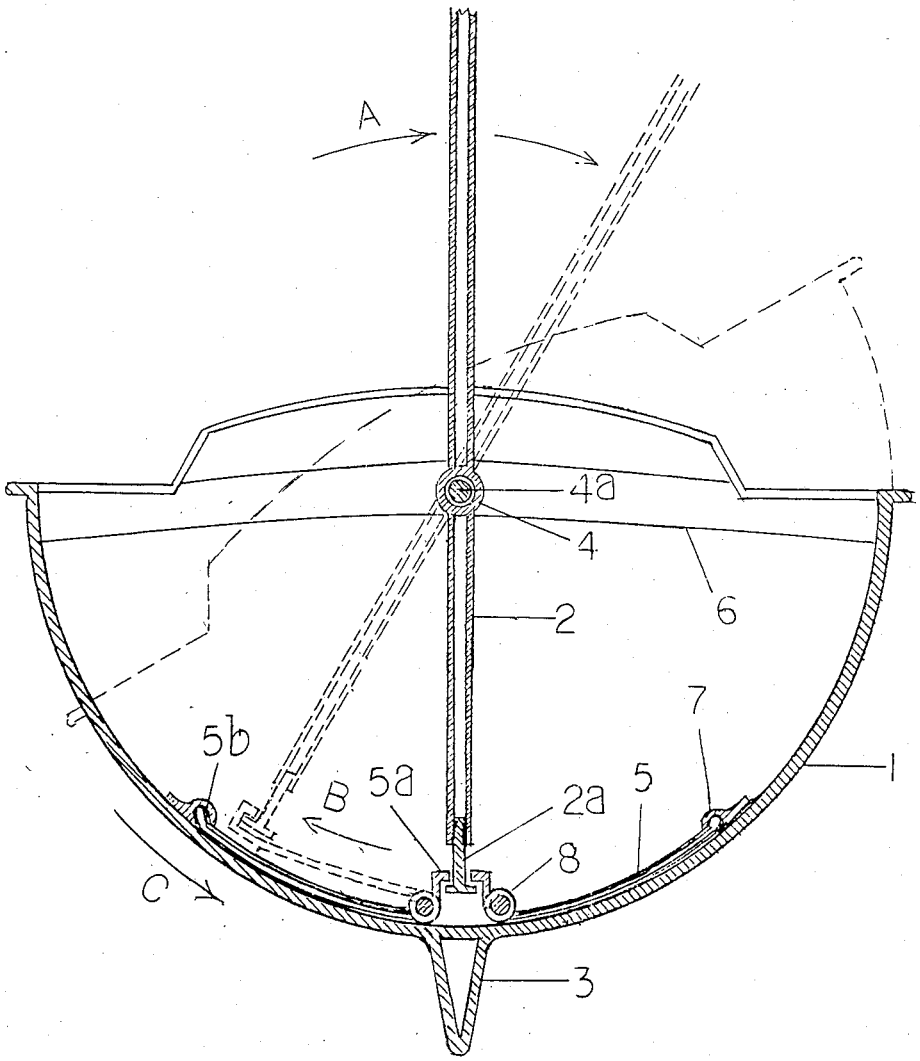
FIG. 1 is a view showing a transverse section of a boat in accordance with the present invention.
Figure 1B:
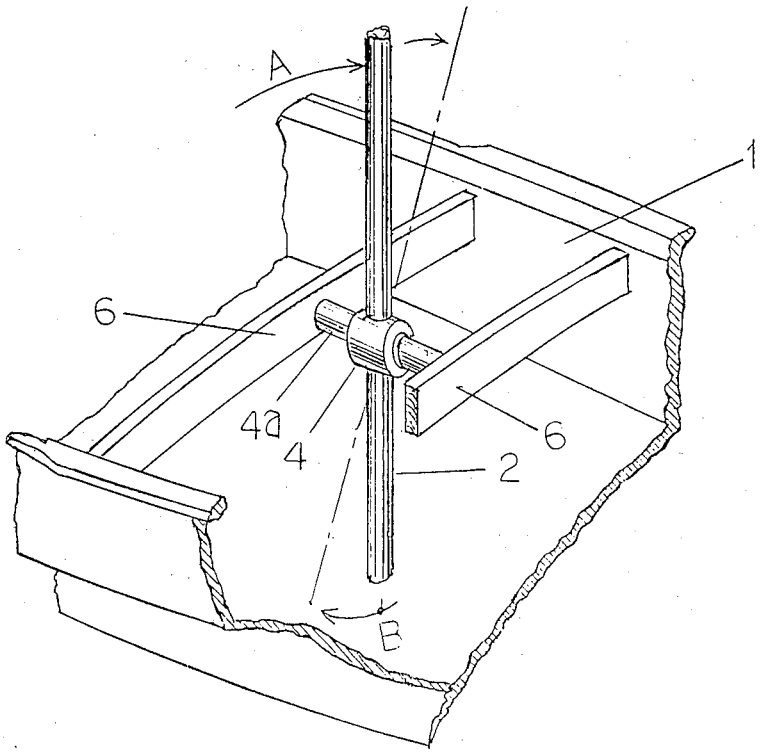
FIG. 1B is a perspective view showing a fragment of the inventive boat of FIG. 1.
Figure 1A:
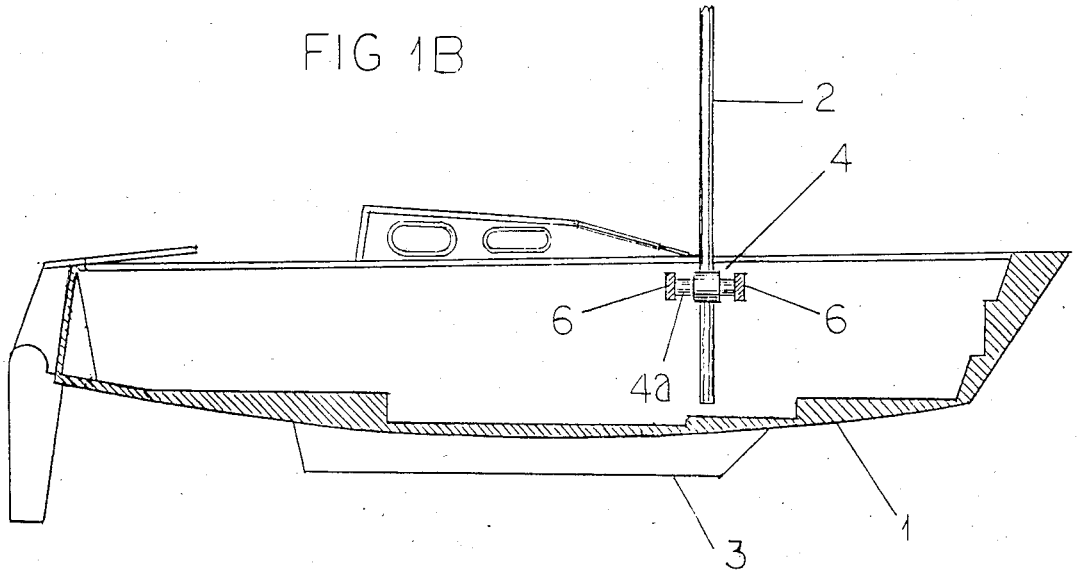
FIG. 1A is a view showing a longitudinal section of the inventive boat of FIG. 1.

FIGS. 1, 1*a* and 1B show a boat in accordance with one embodiment of the present invention. The boat in accordance with the invention has a boat body or hull identified with reference numeral 1 and a mast identified with reference numeral 2. A ballast 3 is provided on the body 1 and extends substantially along a longitudinal axis of the body.

A short axle 4*a* is fixedly mounted at a predetermined height from the bottom of the boat on two beams 6 which extend transversely to the longitudinal axis of the boat and are fixedly connected with the body 1. The mast 2 is provided in its region spaced from the bottom of the boat with a sleeve 4. The sleeve 4 is fixedly connected with the mast 2 and arranged ont he axle 4*a* turnable relative to the latter.

At least a lower portion of the mast 2 is hollow, and an insert 2*a* is arranged in this portion. Two ropes or similar members 5 are further provided. Each of the topes 5 has one end 5*b* which is fixedly connected with an ear 7 mounted on the body 1. The rope 5 is wound around a roller 8 and has an opposite end 5*a* which cooperates with the insert 2*a* as will be explained herein below. The end 5*a* of the ropes 5 can be formed as a stiff shoulder which engages with a respective shoulder at the lower end of the insert 2*a*.

The construction shown in FIGS. 1, 1A and 1B operates in the following manner. When during sailing wind conditions take place, the wind force produces a longitudinal wind force component which is directed along the longitudinal axis of the boat and is not shown in the drawing. It also produces a lateral wind force component which acts, for example, in the direction identified by arrow A. This lateral wind force components turns the mast 2, for example, in clockwise direction as shown in the drawing. The upper portion of the mast 2 located above the axle 4*a* turns to the right as identified by arrow A, whereas the lower portion of the mast 2 located below the axle 4*a* turns to the left as identified by arrow B. The insert 2*a* of the mast 2 displaces the end portion 5*a* of the left rope 5 to the left and thereby pulls the opposite end 5*b* of the same rope to the right. Since the end 5*b* of the left rope 5 is connected with the ear 7 which is fixedly mounted on the body 1, the body 1 is turned to the right in the counterclockwise direction identified by the arrow C. During this turning the body 1 because of its weight resists the turning of the mast in the direction A. The body 1 finally assumes a position shown in broken lines in FIG. 1. In this position the center of gravity of the body 1 is displaced to the right, and therefore the body 1 under the action of its own weight tends to turn back in clockwise direction to the left ot its initial balanced position and also to return the amst 2 back to its initial vertical position. It is believed to be clear that the weight of the body 1 is sufficient for producing such a counteracting force, so that 25 the ballast 3 can be dispensed with in many cases.

When the lateral wind force component acts in a lateral direction which is opposite to the direction identified with reference numeral A, the right rope 5 is involved in counteracting of this component, and the process is similar to the above described one.

As can be understood from the description of the operation of the inventive boat in accordance with this embodiment, since the mast 2 is turnable relative to the body 1, the lateral wind force component is now completely separated from the longitudinal wind force component. The longitudinal wind force component is preserved in its full capacity to propel the boat. The lateral wind force component which turns the mast 2 in a respective lateral direction simultaneously causes a counteraction with a counter force which eventually tends to displace the mast to its initial vertical position and therefore to achieve the balance. Therefore the danger of lateral capsizing of the boat is eliminated or considerably reduced.

Figures 2, 2A:
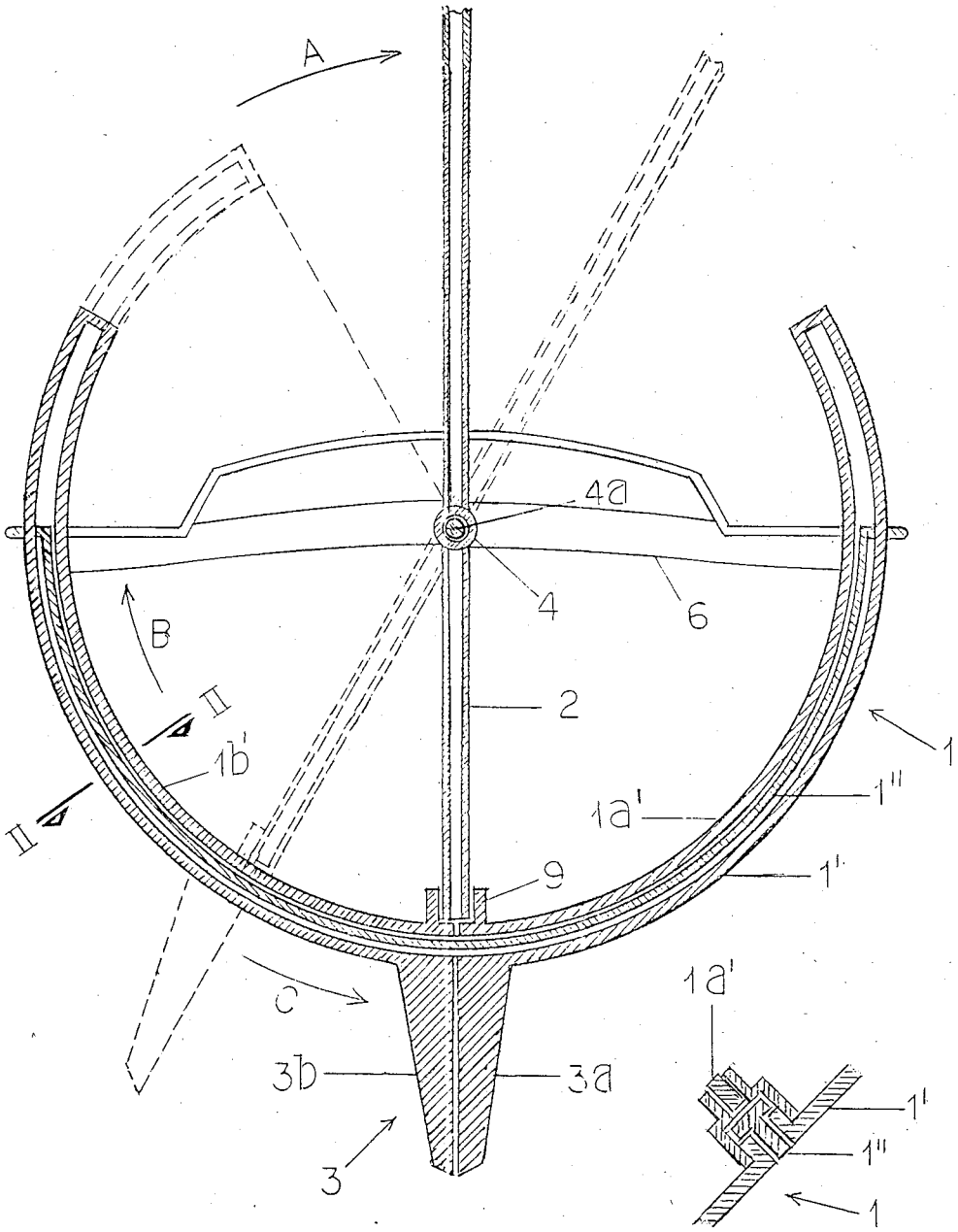
FIG. 2 is a view showing a transverse section of the inventive boat in accordance with another embodiment of the present invention.
FIG. 2A is a view showing a section taken along the line II—II in FIG. 2.

The boat in accordance with the embodiment shown in FIGS. 2 and 2*a* has a body 1 which is composed of two body parts 1' and 1''. The body part 1' has a groove, while the body part 1'' is arranged in the groove of the body part 1' so that the body parts are turnable relative to one another. The body part 1' is fixedly connected via the beams 6 with the axle 4*a*, and the sleeve 4 of the mast 2 is arranged turnably on the axle 4*a*. The body part 1' is composed of two half body parts 1*a*' and 1*b*' each provided with a respective ballast half 3*a* and 3*b*. Each half body part 1*a*' and 1*b*' has at its lower end a shoulder 9 engageable with the lower end of the mast 2.

When the lateral wind force component turns the mast 2, for example, in clockwise direction, the lower end of the mast 2 displaces the left half body part 1*b*' via its shoulder 9 in clockwise direction to the left as identified by arrow B, together with the half ballast 3*b*. The half body part 1*b*' together with the half ballast 3*b* tends to turn to the right in counterclockwise direction identified by arrow C, under the action of its own weight and therefore urges the mast 2 in the counterclockwise direction so as to counteract the action of the lateral wind force component A. It is to be understood that in the embodiment shown in FIG. 2 it is not necessary to form the body part 1' of two half body parts 1*a*' and 1*b*'. Instead, the body part 1' can be formed as a one-piece integral member. The subdivision of the body part 1' into two half body parts 1*a*' and 1*b*' is somewhat advantageous, since when one half body part, for example 1*b*', is turned in one direction, the other half body part, for example 1*a*', is retained in its original position and maintains the stability of the boat.

Figures 3, 3A:
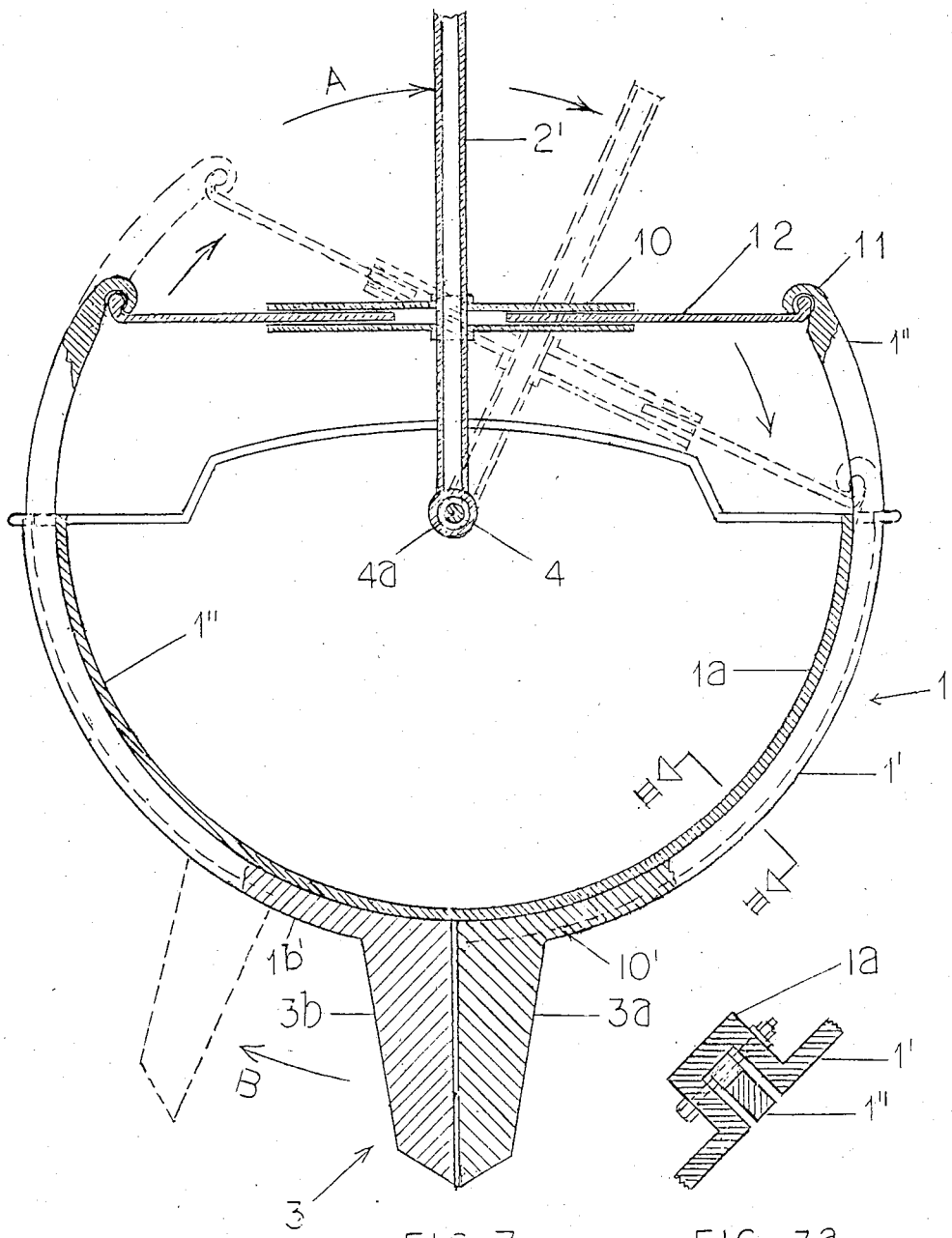
FIG. 3 is a view showing a transverse section of the inventive boat in accordance with yet another embodiment of the invention.
FIG. 3A is a view showing a section taken along the line III—III in FIG. 3.

The boat in accordance with the embodiment shown in FIGS. 3 and 3*a* also has a body 1 which has a body part 1' provided with a groove, and a body part 1'' arranged movable in the groove of the body part 1'. The body part 1' is also composed of two half body parts 1*a*' and 1*b*', and the ballast 3 is also composed of a half ballasts 3*a* and 3*b*.

A mast which is identified with reference numeral 2' has only an upper part extending above the axle 4*a* and is also provided with a sleeve 4 which is turnably arranged on the axle 4*a*. The mast is fixedly connected with two elongated sleeves 10. The upper ends of the half body parts 1*a*'0 ad 1*b*' are provided with shoulders 11 which are inengagement with insert 12 arranged in the sleeves 10 of the mast 2'.

When under the action of the lateral wind force component the mast 2' is turned in clockwise directionidentified by arrow A, the left insert 12 pushes the shoulder 11 of the left half body part 1*b*' with the half ballast 3*b* in clockwise direction. The own weight of the left half body part 1*b*' with the half ballast 3*b* acts in counterclockwise direction so as to counteract the lateral wind force component.

Figure 4:
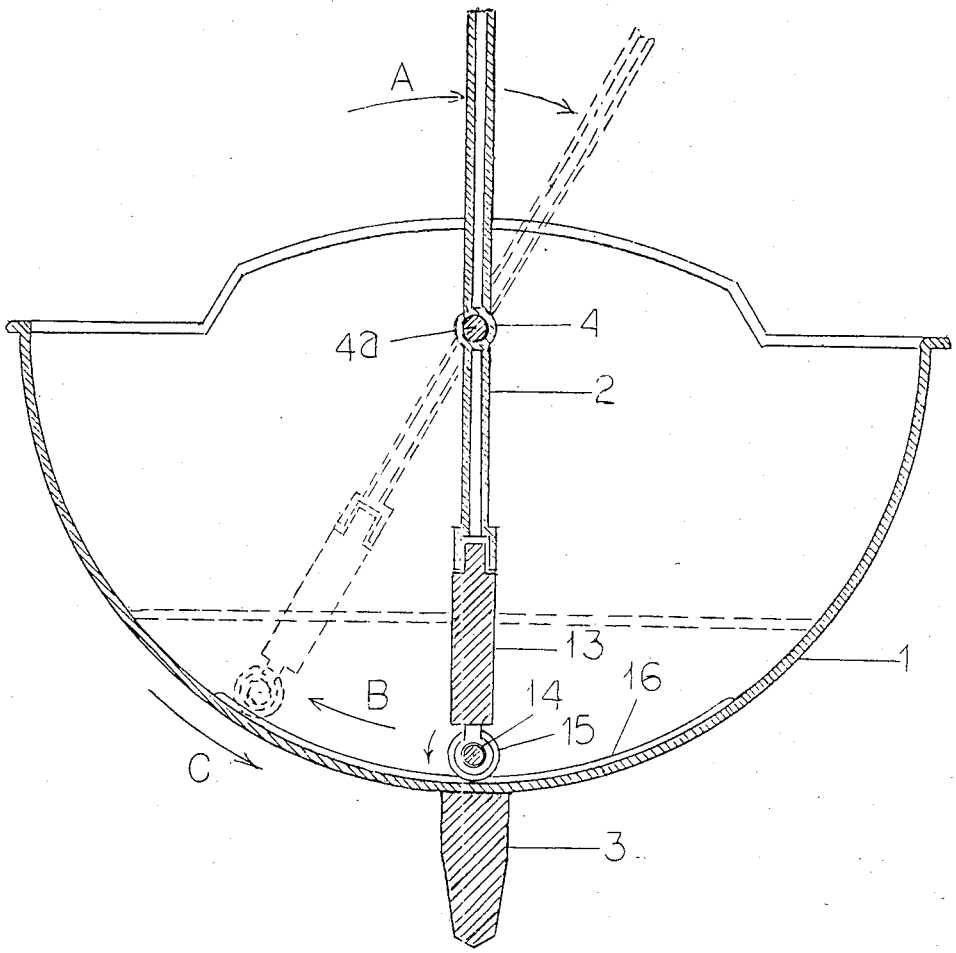
FIG. 4 is a view showing the inventive boat in accordance with a further embodiment of the present invention.

In the boat in accordance with the embodiment shown in FIG. 4 a secondary balance 13 is attached to the lower end of the mast 2. In turn, the lower end of the secondary balance 13 has an ear 14, and an axle of a roller 15 is turnably supported in the ear 14. The inner surface of the body 1 is provided with a guiding track 16. When under the action of the lateral wind force component A the mast 2 is turned in clockwise direction identified by arrow A, the secondary ballast 13 is turned in clockwise direction to the left in direction of the arrow B. The own weight of the ballast 13 tends to turn the lower end of the mast 2 in counterclockwise direction identified by arrow C and therefore to counteract the lateral wind force component.

The roller 14 and/or the guiding track 16 can be made of rubber or other friction increasing material. Therefore a certain resistance to turning of the secondary ballast 13 in the direction of the arrow B is provided, so as to further counteract the action of the lateral wind force component A.

Figure 5:
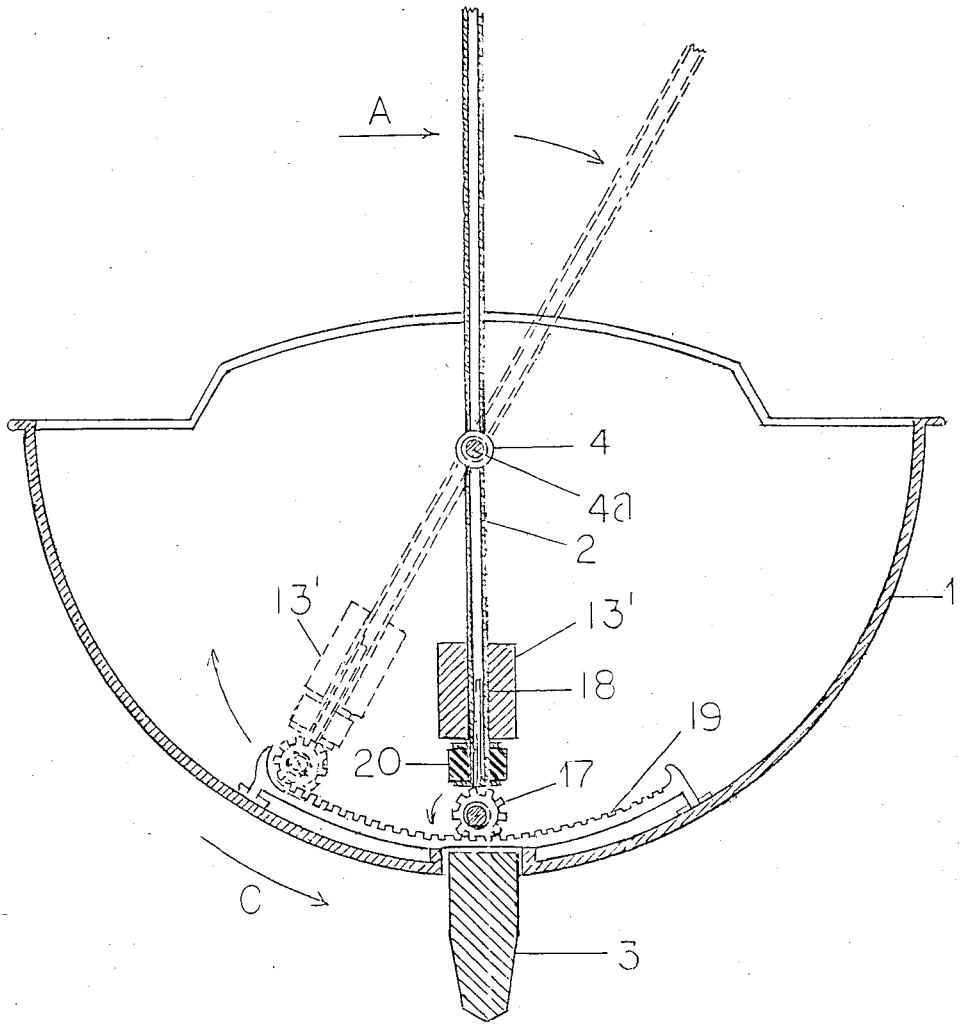
FIG. 5 is a view showing the inventive boat in accordance with still a further embodiment of the present invention.

In the boat in accordance with the embodiment shown in FIG. 5 a toothed wheel 17 is mounted on a rod 18 which is displaceable in an opening of the lower portion of a mast 2. A curved toothed rack 19 is mounted on the inner surface of the body 1. A compressed ring 20 or another springy member urges the toothed wheel 17 into engagement with the toothed rack 19. A secondary ballast 13' is also arranged on the lower portion of the mast 2. When the lateral wind force component turns the mast 2 in clockwise direction identified by arrow A, the toothed wheel 17 moves in engagement with the toothed rack 19 to the left in direction of the arrow B. The pressure applied by the rubber ring 20 to the toothed wheel 17 increases the friction and produces certain resistance to the movement of the latter along the toothed rack 19 so as to counteract the lateral wind force component. The secondary ballast 13' further increases the above mentioned resistance so as to counteract the wind force component. In the left most position shown in FIG. 5, the secondary ballast 13' urges the lower portion of the mast 2 in the direction of the arrow C to its initial position.

Figure 6:
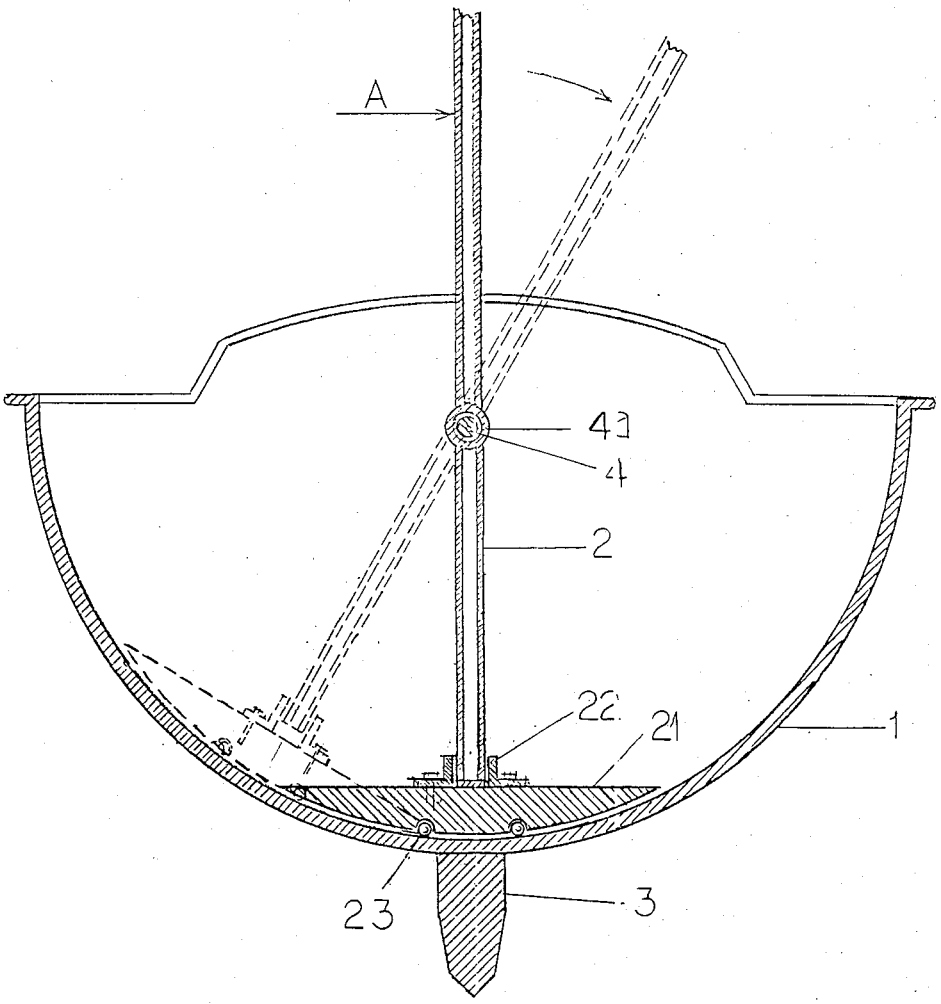
FIG. 6 is a view showing the inventive boat in accordance with an additional embodiment of the invention.

In the embodiment shown in FIG. 6, the lower portion of the mast 2 is connected with a secondary ballast 21 by connecting means 22. The secondary ballast 21 has a lower surface with a shape substantially corresponding to the shape of hte inenr surface of the body 1. Additional rollers 23 can be provided between the lower surface of the secondary ballast 21 and the inner surface of the body 1. The operation of the construction shown in FIG. 6 is substantially similar to the operation of the construction shown in FIG. 5, and therefore it is believed that detailed explanations are not necessary.

Figure 7:
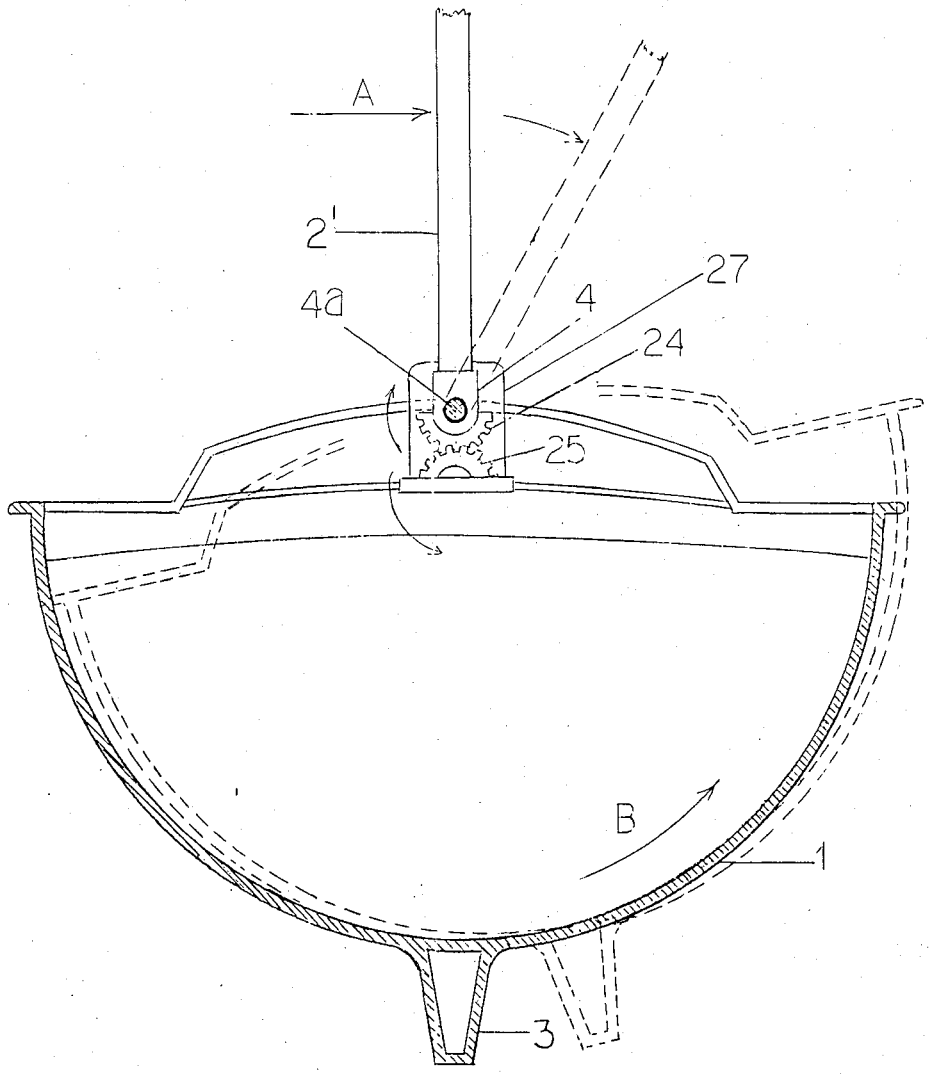
FIG. 7 is a view showing the inventive boat in accordance with a still additional embodiment of the invention.

In the boat in accordance with the embodiment shown in FIG. 7, a toothed wheel or more particularly a toothed segment 24 is fixedly connected with the lower end of the mast 2. The body 1 is fixedly connected with a toothed wheel or more particularly a toothed segment 25, for example via beams 26. The lower end of the mast 2 is again provided with the sleeve 4 which is mounted turnably about an axle 4*a*. The axle 4*a* is fixedly connected with additional brackets 27 mounted on the beams 6. When the lateral wind force component turns the mast 2' in clockwise direction, the toothed wheel 24 fixedly connected with the mast 2' rotates also in clockwise direction, while the toothed wheel 25 which is fixedly connected with the body 1 rotates in counterclockwise direction about the axis 4*a*. Therefore the body 1 is also turned in counterclockwise direction identified by the arrow B. The own weight of the body 1 resists it sturning and counteracts the lateral wind force component. At the same time, it returns the mast to it initial position by rotating the toothed wheesl 25 and 24 in opposite directions.

It will be understood that each of the elements described above, or two or more together, may also find a useful application in other types of constructions differing from the types described above.

While the invention has been illustrated and described as embodied in a boat with a mast, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A boat, comprising a body having a longitudinal axis; a mast arranged on said body so that under the action of a wind component acting in a lateral direction transverse to said longitudinal axis, said mast turns relative to said body clockwise or counterclockwise; and means for connecting said mast with said body so that when said mast is turned clockwise said mast forcedly turns said body counterclockwise and vice versa, said connecting means including at least two rope members each having a distal end which is connected with said body at a location laterally spaced from said mast and proximal end which cooperates with said mast so that when said mast is turned clockwise it pulls said rope member clockwise and thereby pushes said body counterclockwise and vice versa.

2. A boat as defined in claim 1, wherein said mast has a lower end, said boat having an inner surface, said rope members being fixedly connected at their distal ends ot said inner surface of said boat and cooperating by said proximal ends with said lower end of said mast.

3. A boat, comprising a body having a longitudinal axis; a mast arranged on said body so that under the action of a wind component acting in a lateral direction transverse to said longitudinal axis, said mast turns relative tos aid body clockwise or counterclockwise; and means for connecting said mast with said body so that when said mast is turned clockwise said mast forcedly turns said body counterclockwise and vice versa, said connecting emans including at least two gear members which are in engagement with one another, one of said gear members being fixedly connected with said mast and the other of said gear members fixedly connected with said body so that when said mast is turned clockwise said first gear member is turned clockwise and thereby turns said other gear member counterclockwise so as to thereby turn said body counterclockwise and vice versa.

4. A boat as defined in claim 3, wherein said body is provided with two spaced members fixedly connected with said body, said one gear member being pivotably mounted on one of said spaced members, while said other gear member being fixedly mounted on the other of said spaced members.

* * * * *